US005866897A

United States Patent [19]

Nishizawa

[11] Patent Number: 5,866,897

[45] Date of Patent: Feb. 2, 1999

[54] OPTICAL WAVEFORM DETECTING DEVICE

[75] Inventor: Mitsunori Nishizawa, Hamamatsu, Japan

[73] Assignee: Hamamatsu Photonics K.K., Shizuoka-Ken, Japan

[21] Appl. No.: 906,895

[22] Filed: Aug. 6, 1997

[30] Foreign Application Priority Data

Aug. 6, 1996 [JP] Japan ..... 8-207205

[51] Int. Cl.[6] ..... H01J 31/50

[52] U.S. Cl. ..... 250/214 VT; 313/529

[58] Field of Search ..... 250/214 VT, 214 R; 313/529, 537, 105 CM, 103 CM

[56] References Cited

U.S. PATENT DOCUMENTS

| | | | |
|---|---|---|---|
| 4,769,705 | 9/1988 | Lendaro | 358/158 |
| 4,942,293 | 7/1990 | Koishi et al. | 250/214 VT |
| 4,947,031 | 8/1990 | Koishi et al. | 250/214 VT |

FOREIGN PATENT DOCUMENTS

| | | | |
|---|---|---|---|
| 8-116241 | 5/1996 | Japan | H03K 5/00 |
| 2 186 113 | 8/1987 | United Kingdom | H01J 31/50 |
| 2 226 631 | 7/1990 | United Kingdom | G01R 13/02 |
| 2 230 602 | 10/1990 | United Kingdom | H01J 31/08 |
| 2 245 059 | 12/1991 | United Kingdom | H01J 31/26 |

OTHER PUBLICATIONS

"Universal Streak Camera",Toru Tsuchiya et al., Jul. 20, 1984, pp. 31–41.

"Reduction of Phase Noise in Passively Mode–Locked Lasers", Walker et al., IEEE Journal of Quantum Electronics, Jan. 1992; pp. 289–296.

"Time Synchronisation Measurements Between Two Self–Modellocked Ti;sapphire Lasers"; Spence et al., Optics Communications 101(1993) 286–296.

*Primary Examiner*—Edward P. Westin
*Assistant Examiner*—Kevin Pyo
*Attorney, Agent, or Firm*—Sughrue, Mion, Zinn, Macpeak & Seas, PLLC

[57] ABSTRACT

The optical trigger 22 outputs a trigger signal in. synchronization with a pulse beam falling incident on the photocathode 91 of the streak tube 90. The deflection voltage generator 50 applies a pair of deflection voltages to the deflection electrodes 93 and 93' in the streak tube 90. The differential amplifier 60 detects the deflection voltages, and outputs a deflection voltage detection signal. The delay comparator 71 detects a time difference between the deflection voltage detection signal and the trigger signal, and outputs a difference signal indicative of the detected time difference. Based on the difference signal, the voltage control delay circuit 41 controls a delay amount of the deflection voltages to be outputted from the generator 50.

19 Claims, 9 Drawing Sheets

TRIGGER SIGNAL OUTPUTTED FROM TRIGGER 22

REFERENCE SIGNAL OUTPUTTED FROM VOLTAGE CONTROL DELAY CIRCUIT 41

DEFLECTION VOLTAGE APPLIED TO DEFLECTION ELECTRODE 93

INTENSITY OF FLUORESCENCE INPUTTED TO STREAK TUBE 90

OPTICAL WAVEFORM DETECTING DEVICE

BACKGROUND OF THE INVENTION

1. Field of the Invention

The present invention relates to an optical waveform detecting device for detecting a high speed optical phenomenon such as nanosecond through femtosecond pulses of fluorescent light.

2. Description of Related Art

A streak tube is preferably used for detecting such a high speed optical phenomenon.

SUMMARY OF THE INVENTION

FIG. 1 shows a structure of a conceivable optical waveform detecting device provided with a streak tube. The streak tube 9 is a tube-shaped closed container whose interior is evacuated. A photocathode 9*a* is formed on one end of the streak tube 9. When an optical beam, to be detected, falls incident on the photocathode 9*a*, an electron beam is emitted from the photocathode 9*a*. The electron beam is deflected by an electric field developed between a pair of deflection electrodes 9*b* and 9*b'* which are respectively applied with deflection voltage signals. A streaked image is therefore produced on an output surface 9*a*, which is located opposite to the photocathode 9*a*.

A pulse laser beam emitted from a laser source 1 is splitted by a beam splitter 2 into two beams. One of the two beams is irradiated onto a sample 3. When a pulse laser beam is thus irradiated on the sample 3, fluorescent substance in the sample emits fluorescent light, which is guided by an optical system 4 toward the photocathode 9*a*. The other one of the two pulse beams is photo-electrically converted by an optical trigger 5 into an electric trigger signal. The phase of the trigger signal is then shifted by a phase shifter 6 by a predetermined amount of delay. The trigger signal is then inputted to a resonator 8 via an impedance matching device 7. Based on the inputted trigger signal, the resonator 8 generates deflection voltages to be applied to the pair of deflection electrodes 9*b* and 9*b'*. For example, the deflection voltages, applied to the pair of electrodes 9*b* and 9*b'*, are ramp signals having opposite polarities to each other. The deflection voltages establish a temporarily-changing electric field between the pair of parallel electrodes 9*b* and 9*b'*. The temporarily changing electric field deflects the electron beam, thereby streak sweeping the electron beam. As a result, a streaked image is obtained on the output surface 9*c*.

It is now assumed that the sample 3 emits a very weak intense light. In this case, the intensity of a streaked image obtained by a single streak sweeping operation is very small. Accordingly, the streaked image has a low signal-to-noise ratio. This problem becomes serious when the measurement is performed according to a photon-counting method. In order to obtain a streaked image of a high signal-to-noise ratio for the very weak intense light, therefore, the streak sweeping has to be performed many times, and obtained streaked images are accumulated into a single streaked image.

For example, the optical waveform detecting device of FIG. 1 is combined with a CCD of a type which can read out images at a television rate. The CCD is provided for reading out, at the television rate, the streaked images formed on the output surface 9*c*. The outputs from the CCD are transferred to a frame memory and then subjected to an image processing operation. Theoretically, this system can provide streaked images at a frequency of 30 Hz at maximum. However, this system can actually read out the streaked images at about 10 Hz at maximum due to generated noises and due to the transfer period required to transfer data from the CCD to the frame memory.

In order to obtain a streaked image at a signal-to-noise ratio of 10,000, for example, it is necessary to read out a streaked image with its peak value of 10,000 counts when a noise has a value of one count. In order to measure the lifetime of fluorescent light, it is necessary to further increase the number of streaked image reading operation to be performed by ten times. In this case, the total period of detecting time becomes about 167 minutes. Thus, detection operation has to be performed during several tens minutes to several hours in order to obtain a streaked image with a high signal-to-noise ratio for a weak light.

The resonator 8 repeatedly generates deflection voltages with amplitudes of several kilovolts at a fixed repetition frequency. The resonator B therefore generates heat. The oscillation characteristic of the resonator 8 changes due to the generated heat. For example, even when the resonator 8 is subjected to a warming up operation, the timing of the deflection voltages will drift at about 200 femtoseconds/minute. The temporal resolution of the optical waveform detecting device is determined dependent on the product of the detecting time and the deflection voltage drift amount. For example, when the detecting time is 100 minutes and the deflection voltage drift amount is 200 femtoseconds/minute, the temporal resolution becomes 20 picoseconds. It is impossible to measure the fluorescence lifetime, which is required to be detected at a temporal resolution of about one picosecond.

Additionally, when the sweeping range is switched from one to another, the power consumed by the resonator 8 changes. It takes about ten minutes before the resonator 8 is stabilized. While the resonator 8 is in the unstable condition, the timing of the deflection voltage will drift at a rate of 100 picoseconds/minute or more. It is therefore impossible to perform a detection operation until the resonator 8 becomes stable. The detecting efficiency becomes low.

It is conceivable to decrease the deflection voltage drift amount through controlling the temperature of the resonator 8 to be maintained at a fixed value. However, the amount of heat generated at the resonator 8 is very large, and therefore it is impossible to actually maintain the temperature at the fixed value.

The present invention is performed in order to solve the above-described problems. An object of the present invention is therefore to provide an improved optical waveform detecting device which can obtain a streaked image with a high signal-to-noise ratio and with a high temporal resolution even for a low intense light and which can immediately start its detecting operation after the sweeping range is changed.

In order to attain the above and other objects, the present invention provides an optical waveform detecting device for detecting a waveform of a pulse-shaped optical beam, the device comprising: a streak tube having a photoelectric conversion surface for receiving a pulse-shaped optical beam and for emitting an electron beam according to an intensity of the optical beam, a deflection electrode for forming an electric field in a direction orthogonal to a direction in which the electron beam travels, thereby deflecting the electron beam, and an output surface for receiving the electron beam and for outputting a streaked image in accordance with an intensity of the received electron beam;

trigger signal generating means for generating a trigger signal in synchronization with the optical beam; deflection voltage generating means for generating a deflection voltage based on the trigger signal, and for applying the deflection voltage onto the deflection electrode; deflection voltage detection means for detecting the deflection voltage applied to the deflection electrode, and for outputting a deflection voltage detection signal indicative of the detected deflection voltage; comparing means for detecting difference between a timing of the deflection voltage detection signal and a timing of the trigger signal and for outputting a difference signal indicative of the detected timing difference; and deflection voltage control means for outputting a reference signal, based on the difference signal, for controlling a timing of the deflection voltage to be outputted from the deflection voltage generating means to the deflection electrode.

When the trigger signal generating means generates a pulse-shaped trigger signal upon receiving a pulse-shaped optical beam, the deflection voltage generating means may generate a deflection voltage of a predetermined waveform based on the trigger signal and apply the deflection voltage onto the deflection electrode, the deflection voltage detection means detecting the deflection voltage and outputting a deflection voltage detection signal. The comparing means may receive both the deflection voltage detection signal and the trigger signal, and detect time difference between a reception time of the deflection voltage detection signal and a reception time of the trigger signal, the comparing means outputting a difference signal indicative of the detected time difference. The deflection voltage control means may output the reference signal, based on the difference signal, for controlling a generating timing of the deflection voltage to be applied to the deflection electrode.

When the trigger signal generating means generates an approximately sine wave-shaped trigger signal upon receiving the optical beam, the deflection voltage generating means may generate an approximately sine wave-shaped deflection voltage based on the trigger signal and apply the sine wave-shaped deflection voltage onto the deflection electrode, the deflection voltage detection means detecting the approximately sine wave-shaped deflection voltage and outputting an approximately sine wave-shaped deflection voltage detection signal. The comparing means may receive both the deflection voltage detection signal and the trigger signal, and detect phase difference between a phase of the deflection voltage detection signal and a phase of the trigger signal, the comparing means outputting a difference signal indicative of the detected phase difference. The deflection voltage control means may output the reference signal, based on the difference signal, for controlling a phase of the deflection voltage to be outputted to the deflection electrode.

According to another aspect, the present invention provides an optical waveform detecting device for detecting a waveform of a pulse-shaped optical beam, comprising: a streak tube having a photoelectric conversion surface for receiving a pulse-shaped optical beam and for emitting an electron beam according to an intensity of the optical beam, a deflection electrode for forming an electric field in a direction orthogonal to a direction in which the electron beam travels, thereby deflecting the electron beam, and an output surface for receiving the electron beam and for outputting a streaked image in accordance with an intensity of the received electron beam; a trigger signal generator for generating a trigger signal in synchronization with the optical beam; a reference signal generator for generating a reference signal; a deflection voltage generator for receiving the reference signal, for generating a deflection voltage based on the reference signal, and for applying the deflection voltage onto the deflection electrode; a deflection voltage detector for detecting the deflection voltage applied to the deflection electrode, and for outputting a deflection voltage detection signal indicative of the detected deflection voltage; and a feedback controller for receiving both the deflection voltage detection signal and the trigger signal, for detecting time difference between a reception time of the deflection voltage detection signal and a reception time of the trigger signal, and for outputting, to the reference signal generator, a difference signal indicative of the detected timing difference, the difference signal feedback controlling the time when the reference signal generator generates the reference signal.

According to still another aspect, the present invention provides an optical waveform detecting device for detecting a waveform of a pulse-shaped optical beam, comprising: a streak tube having a photoelectric conversion surface for receiving a pulse-shaped optical beam and for emitting an electron beam according to an intensity of the optical beam, a deflection electrode for forming an electric field in a direction orthogonal to a direction in which the electron beam travels, thereby deflecting the electron beam, and an output surface for receiving the electron beam and for outputting a streaked image in accordance with an intensity of the received electron beam; a trigger signal generator for generating a trigger signal in synchronization with the optical beam; a reference signal generator for generating a reference signal; a deflection voltage generator for receiving the reference signal, for generating a deflection voltage based on the reference signal, and for applying the deflection voltage onto the deflection electrode; a deflection voltage detector for detecting the deflection voltage applied to the deflection electrode, and for outputting a deflection voltage detection signal indicative of the detected deflection voltage; and a feedback controller for receiving both the deflection voltage detection signal and the trigger signal, for detecting phase difference between a phase of the deflection voltage detection signal and a phase of the trigger signal, and for outputting, to the reference signal generator, a difference signal indicative of the detected phase difference, the difference signal feedback controlling the phase of the reference signal to be outputted from the reference signal generator.

BRIEF DESCRIPTION OF THE DRAWINGS

The above and other objects, features and advantages of the invention will become more apparent from reading the following description of the preferred embodiment taken in connection with the accompanying drawings in which:

FIG. 3(*b*) shows a balanced-to-unbalanced transformer 60;

DETAILED DESCRIPTION OF THE PREFERRED EMBODIMENTS

Figure 1:
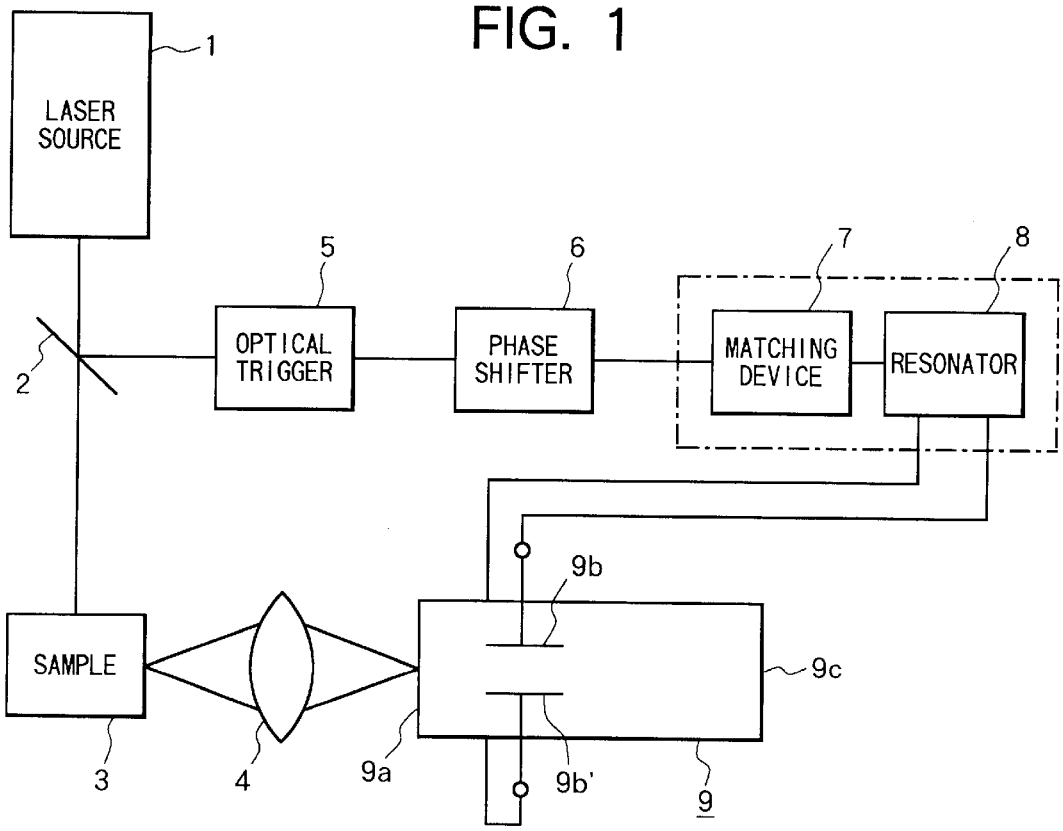
FIG. 1 shows a structure of a conceivable optical waveform detecting device.

An optical waveform detecting device according to preferred embodiments of the present invention will be described while referring to the accompanying drawings wherein like parts and components are designated by the same reference numerals to avoid duplicating description.

First, a streak tube employed in the optical waveform detecting device of the embodiments according to the present invention will be described below.

Figure 2:
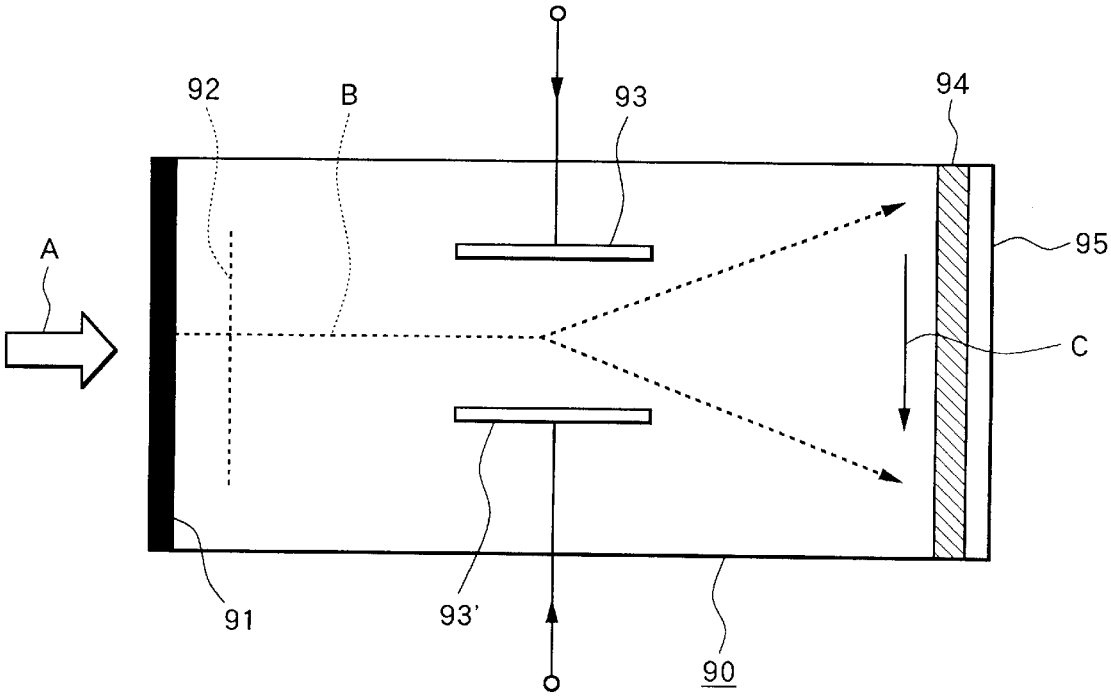
FIG. 2 shows a structure of a streak tube employed in an optical waveform detecting device according to embodiment of the present invention.

FIG. 2 shows a structure of the streak tube.

The streak tube 90 is a tube-shaped closed container whose interior is evacuated. One end surface of the streak tube 9 is formed with a photocathode 91. An opposite end surface is formed with a phosphor screen 95. An accelerating electrode 92 is located in front of the photocathode 91. A microchannel plate (MCP) 94 is provided in front of the phosphor screen 95. A pair of deflection electrodes 93 and 93' are located between the accelerating electrode 92 and the MCP 94.

When an optical beam A, to be detected, falls incident on the photocathode 91, photoelectrons are emitted from the photocathode 91. The number of the photoelectrons corresponds to the intensity of the optical beam A. The photoelectrons are then accelerated by an accelerating voltage applied to the accelerating electrode 92. Thus, the phot6electrons travel as an electron beam B in the closed container to reach the microchannel plate (MCP) 94. The electron beam B is then multiplied by the, microchannel plate (MCP) 94 before reaching the phosphor screen 95. The phosphor screen 95 emits a phosphor light. The intensity of the phosphor light corresponds to the number and energy amount of the electrons reached on the screen 95. That is, the intensity of the phosphor light corresponds to the intensity of the light A.

It is noted that the phosphor screen 95 may not be provided. An image pick up device may be located in place of the phosphor screen 95. The image pick up device may be controlled to directly pick up the streaked image.

The pair of electrodes 93 and 93' are located sandwiching therebetween the passage (traveling path) of the electron beam B. Each of the electrodes 93 and 93' is constructed from a planar plate electrode. The electrodes 93 and 93' generate an electric field therebetween in a direction substantially orthogonal to the traveling path of the electron beam B according to deflection voltages applied thereto. The electric field deflects the electron beam B. By applying the deflection voltages to the electrodes 93 and 93', the electron beam B is streak swept in a direction C along the phosphor screen 95. Temporal changes in the intensity of the light A are therefore converted into spatial changes on the screen 95. The spatial changes on the screen 95 are observed.

An optical waveform detecting device according to a first embodiment of the present invention will be described below with reference to FIGS. 3(*a*), 3(*b*), and 4(*a*)–4(*d*).

Figure 3:
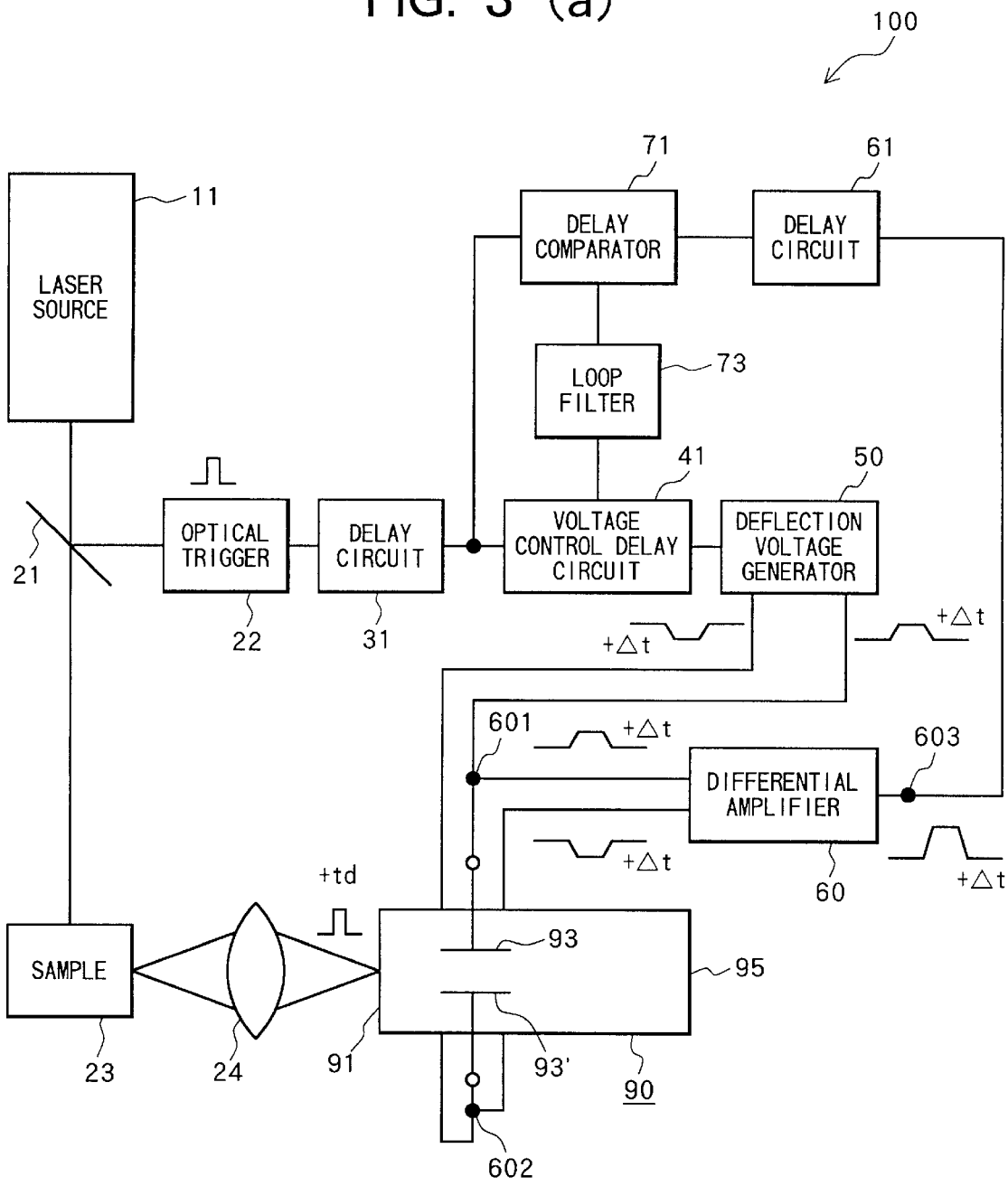
FIG. 3(*a*) shows a structure of an optical waveform detecting device of a first embodiment of the present invention.
Figure 3:
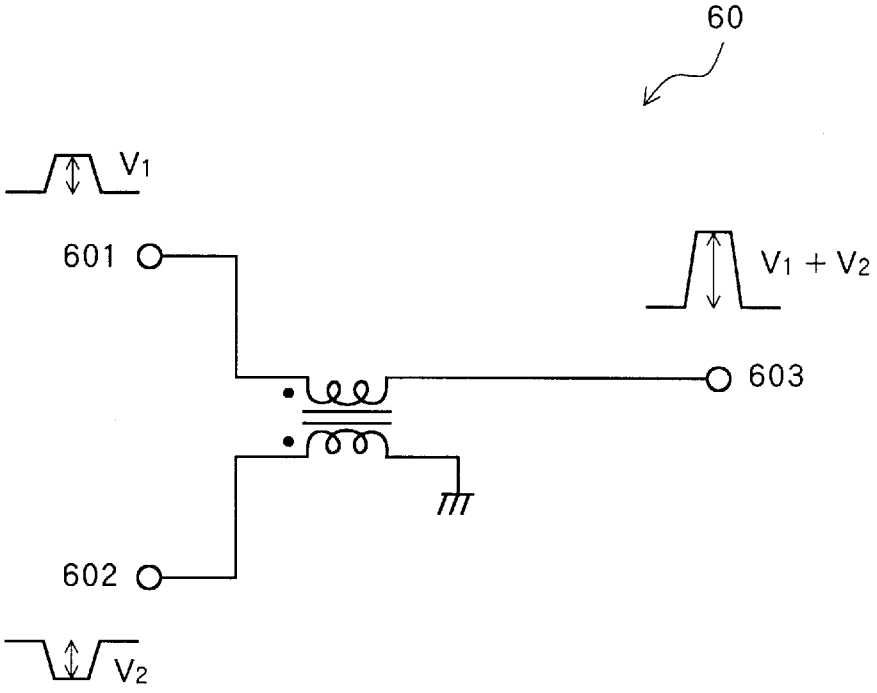

FIG. 3(*a*) shows a structure of the optical waveform detecting device 100 of the first embodiment. In this figure, the optical waveform detecting device 100 is used for detecting fluorescent light emitted from a sample 23 through detecting a streaked image formed on the phosphor screen 95 of the streak tube 90. This device is effective especially for a single sweeping detection method using trapezoidal, ramp, or sine waveform deflection voltages applied to the deflection electrodes 93 and 93'.

According to the optical waveform detecting device of FIG. 3(*a*), a half mirror 21 is provided in front of a laser source 11. The sample 23 is located at a position for receiving a part of a laser beam that has passed through the half mirror 21. An optical system 24 such as a lens is provided for guiding, toward the streak tube 90, a fluorescent light which the sample 23 emits upon receipt of the laser beam.

An optical trigger 22 is located at a position for receiving a remaining part of the laser beam that has reflected from the half mirror 21. The optical trigger 22 is for converting the received laser beam into an electric trigger signal. The optical trigger 22 is constructed from an avalanche photodiode, a PIN photodiode, or the like for converting an optical signal, with a pulse-shaped intensity change, into a pulse-shaped electrical signal. A delay circuit 31 is electrically connected to the optical trigger 22. The delay circuit 31 is for receiving the trigger signal and for outputting the trigger signal at a timing delayed by a predetermined amount of delay time. A voltage control delay circuit 41 is electrically connected to the delay circuit 31. The voltage control delay circuit 41 is electrically connected also to a loop filter 73. The voltage control delay circuit 41 is a delay circuit whose delay amount can be controlled with a voltage signal inputted to the delay circuit 41. The delay circuit 41 is for receiving the trigger signal outputted from the delay circuit 31, and for receiving a difference signal outputted from the loop filter 73. The delay circuit 41 outputs, as a reference signal, the trigger signal at a timing delayed by an amount of delay time which is determined by the difference signal.

A deflection voltage generator 50 is electrically connected to the voltage control delay circuit 41. The deflection voltage generator 50 is for generating a pair of deflection voltage signals in synchronization with the reference signal supplied from the voltage control delay circuit 41. The deflection voltage generator 50 is constructed to output, when receiving a pulse signal, a pair of voltage signals which have the same waveform (such as a trapezoidal, ramp, or sine waveform) but which have electric polarities opposite to each other. The deflection voltage generator 50 applies the pair of deflection voltages respectively t o the deflection electrodes 93 and 93' in the streak tube 90.

The deflection electrodes 93 and 93' are electrically connected to a differential amplifier 60. The differential amplifier 60 is for detecting an electric potential is difference developed between the deflection electrodes 93 and 93' and for outputting a deflection voltage detection signal indicative of the detected electric potential difference. A delay circuit 61 is electrically connected to the differential amplifier 60. The delay circuit 61 is for receiving the deflection voltage detection signal and for outputting the deflection voltage detection signal at a timing delayed by another predetermined amount of delay time.

A delay comparator 71 is electrically connected to the delay circuit 61. The delay comparator 71 is electrically connected also to the delay circuit 31. The delay comparator 71 is for receiving the deflection voltage detection signal supplied from the delay circuit 61 and for receiving the trigger signal supplied from the delay circuit 31. The delay comparator 71 detects a difference amount between the supplied timing of the trigger signal and the supplied timing of the deflection voltage detection signal. The delay comparator 71 outputs a difference signal indicative of the difference amount. The loop filter 73 is electrically connected to the delay comparator 71. The loop filter 73 is for receiving the difference signal and for transmitting only a low frequency component of the difference signal and supplying the low frequency component of the difference signal to the voltage control delay circuit 41.

The structure of the optical waveform detecting device 100 will be described below in greater detail.

The laser source 11 is for outputting short pulses of laser beam at a high repetition frequency. Representative examples of the laser source 11 include mode-locked lasers such as a titanium sapphire laser, a CPM (colliding pulse modelocking) laser, and a YAG laser. The pulse laser beam outputted from the laser 11 is splitted by the half mirror 21 into two optical beams., One of the two optical beams is guided to the optical trigger 22. The other optical beam is irradiated on the sample 23. When the sample 23 is thus irradiated with the optical beam, a fluorescent substance, located in the sample 23, emits fluorescent light. The fluorescent light is guided along the optical system 24 to fall incident on the photocathode 91 of the streak tube 90.

When receiving the pulse laser beam, the optical trigger 22 outputs a trigger signal in correspondence with the received amount of the pulse laser beam. The trigger signal is therefore repeatedly outputted in synchronization with the repetition frequency of the pulse laser beam. The delay circuit 31 receives the trigger signal, and outputs the trigger signal at a timing delayed by the predetermined fixed delay time. The thus time-delayed trigger signal is then inputted both to the voltage control delay circuit 41 and the delay comparator 71.

The voltage control delay circuit 41 outputs the trigger signal after a delay time passes after the circuit 41 receives the trigger signal. The voltage control delay circuit 41 is controlled by the difference signal, supplied from the loop filter 73, to adjust the amount of the delay time. Thus, the voltage control delay circuit 41 outputs the trigger signal at a timing delayed by the delay time dependent on the difference signal. The circuit 41 thus outputs the delayed trigger signal as a reference signal.

The reference signal is inputted to the deflection voltage generator 50. Upon receiving the reference signal, the deflection voltage generator 50 generates a pair of deflection voltage signals, which have the same waveform such as a trapezoidal waveform, a ramp waveform, or a sine waveform in synchronization with the reference signal, but which have polarities opposite to each other. Accordingly, as the laser source 11 repeatedly emits laser light, the deflection voltage generator 50 repeatedly generates the pair of deflection voltage signals of the predetermined waveform. The voltage generator 50 applies the pair of deflection voltage signals to the deflection electrodes 93 and 93', respectively. Thus, a changing electric field is established in the streak tube 90, according to the electric potential difference between the electrodes 93 and 93', in synchronization with the pulse laser beam emitted from the laser 11 and accordingly with the fluorescent light incident on the photocathode 91.

As the fluorescent light emitted from the sample 23 falls incident on the photocathode 91, the deflection electrodes 93 and 93' are applied with the deflection voltage signals from the voltage generator 50. When the photocathode 91 emits photoelectrons, the photoelectrons are deflected by the electric field established between the deflection electrodes 93 and 93' due to the electric potential therebetween, and are streak swept on the phosphor screen 95. Thus, a streaked image is produced on the phosphor screen 95.

The electric potential difference between the electrodes 93 and 93' (the difference between the pair of deflection voltage signals applied to the electrodes 93 and 93') is detected by the differential amplifier 60. A representative example of the differential amplifier 60 is a balanced-to-unbalanced transformer shown in FIG. 3(*b*). The balanced-to-unbalanced transformer 60 is constructed to detect electric potentials of both the pair of plate electrodes 93 and 93' and to output a signal indicative of an amount of difference between the measured electric potential levels.

As shown in FIG. 3(*b*), the balanced-to-unbalanced transformer 60 has two input terminals 601 and 602 and a single output terminal 603. The input terminal 601 is connected to an electrical line connected between the deflection voltage generator 50 and the deflection electrode 93. The other input terminal 602 is connected to another electrical line connected between the deflection voltage generator 50 and the deflection electrode 93'. The output terminal 603 is connected to the delay circuit 61. The balanced-to-unbalanced transformer 60 has a gain of a value of one (1). With this structure, the deflection voltage signals are applied to the balanced-to-unbalanced transformer 60 simultaneously when they are applied to the electrodes 93 and 93'. When the deflection voltage signals are in the trapezoidal form as shown in FIG. 3(*b*), the balanced-to-unbalanced transformer 60 outputs the deflection voltage detection signal also of the trapezoidal form. The transformer 60 generates the deflection voltage detection signal simultaneously with receiving the deflection voltage signal. It is noted that in order to perform a noise free measurement, it is preferable that the input terminal 601 be connected to the connection line between the voltage generator 50 and the electrode 93 at a position close to the electrode 93. Similarly, it is preferable that the input terminal 602 be connected to the connection line between the voltage generator 50 and the electrode 93' at a position close to the electrode 93'.

In the above description, in order to pick up the electric potential of each of the electrodes 93 and 93', each electrode is directly connected to the differential amplifier 60 as shown in FIG. 3(*a*). However, each electrode may be connected to the differential amplifier 60 via a capacity coupling or an inductive coupling method. Or, the differential amplifier 60 may be constructed to receive electromagnetic waves transmitted from each of the electrodes 93 and 93'. The value of an electric potential difference, measured by the differential amplifier 60, is outputted from the differential amplifier 60 as a deflection voltage detection signal. The deflection voltage detection signal is delayed by the delay circuit 61 by the predetermined delay time before being supplied to the delay comparator 71.

The delay comparator 71 receives the deflection voltage detection signal supplied from the delay circuit 61 and receives the trigger signal supplied from the delay circuit 31. The delay comparator 71 detects a difference between the delay time of the deflection voltage detection signal and the delay time of the trigger signal. The delay comparator 71 then outputs a difference signal indicative of the delay time difference. The difference signal is then supplied to the loop filter 73 where only a low frequency component of the difference signal is transmitted and then inputted to the voltage control delay circuit 41. The delay circuit 41 delays the trigger signal supplied from the delay circuit 31 based on the difference signal supplied from the loop filter 73. The delay circuit 41 thus outputs the delayed trigger signal as the reference signal. More specifically, the delay circuit 41 decreases the delay amount of the reference signal when the difference signal is equal to or higher than a predetermined value, and increases the delay amount of the reference signal when the difference signal is lower than the predetermined value. Thus, the delay circuit 41 feed-back controls the difference signal to be fixed to the predetermined value.

With the above-described structure, the optical .waveform detecting device 100 operates as described below.

Figure 4:
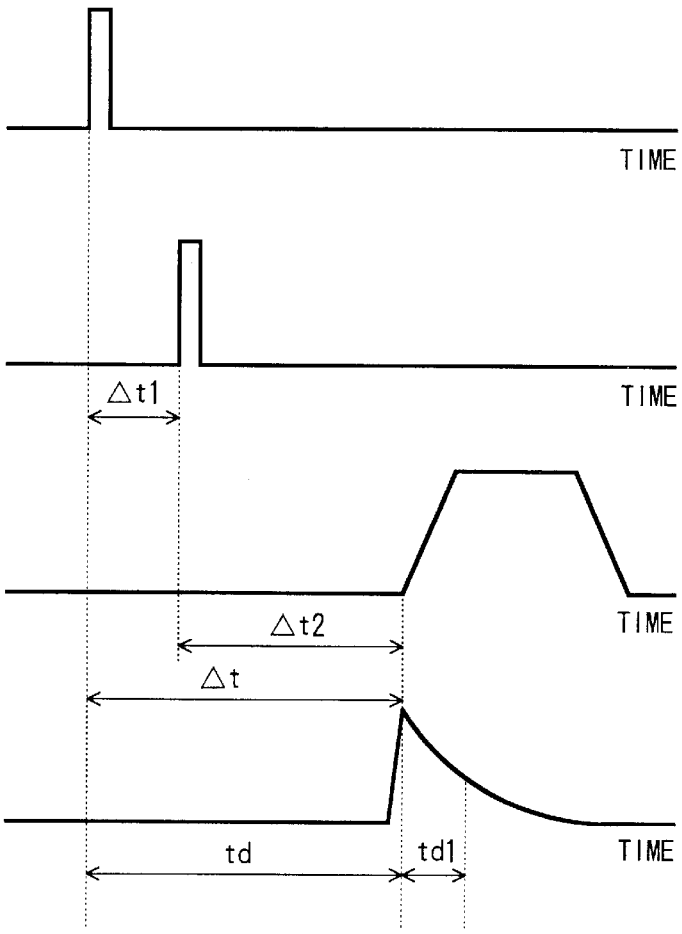
FIGS. 4(*a*)–4(*d*) show how the optical waveform detecting device operates.

FIGS. 4(*a*) through 4(*d*) are operational illustration of the optical waveform detecting device.

The pulse laser beam outputted from the laser source 11 is splitted by the half mirror 21 into two laser beams. One laser beam is inputted into the optical trigger 22, which in turn emits a trigger signal as shown in FIG. 4(*a*). The time when the trigger signal thus rises up will be referred to as a reference time hereinafter.

The trigger signal is then delayed by the delay circuit 31 with the predetermined delay time. The thus delayed trigger signal is further delayed by the voltage control delay circuit 41 in accordance with the difference signal supplied from the loop filter 73. The thus further delayed trigger signal is outputted from the voltage control delay circuit 41 as a reference signal. It is now assumed that as shown in FIG. 4(*b*), the delay circuits 31 and 41 delay the reference signal by a delay time Δt1 in total from the reference time when the trigger signal is originally issued from the optical trigger 22.

The reference signal is then supplied from the delay circuit 41 to the deflection voltage generator 50. The deflection voltage generator 50 generates a pair of deflection voltages of a trapezoidal shape, for example, upon receiving the reference signal. One of the pair of defection voltage signals, that is applied to the electrode 93, is shown in FIG. 4(*c*). The other deflection voltage signal, that is applied to the other electrode 93', has the same waveform as shown in FIG. 4(*c*), but has an electric polarity opposite to that of FIG. 4(*c*). The voltage generator 50 generates the pair of voltage signals simultaneously.

It is noted that as shown in FIG. 4(*c*), the generating timing of the deflection voltage signals is delayed from the reference signal receiving timing by an additional delay time Δt2. The delay amount Δt2 is not fixed, but drifts or varies according to changes in the temperature of the deflection voltage generator 50. Accordingly, the timing of the deflection voltages, applied to the deflection electrodes 93 and 93', is delayed by a total delay time Δt which satisfies the following equation (1):

$$\Delta t=\Delta t1+\Delta t2 \tag{1}$$

Difference between the deflection voltages applied to the deflection electrodes 93 and 93' is detected by the differential amplifier 60, which in turn outputs a deflection voltage detection signal indicative of the detected voltage difference. The deflection voltage detection signal indicates temporal changes in the electric potential difference between the electrodes 93 and 93', i.e., temporal changes in the electric field developed between the electrodes 93 and 93'. The deflection voltage detection signal is further delayed by the predetermined amount of delay by the delay circuit 61, and then inputted to the delay comparator 71.

The delay comparator 71 compares the receiving timing of the deflection voltage detection signal with the receiving timing of the trigger signal inputted from the delay circuit 31. The delay comparator 71 outputs a difference signal indicative of the difference between the receiving timings of the deflection voltage detection signal and the trigger signal. Thus, the difference signal indicates a difference between the delay amount, by which the deflection voltage detection signal is delayed from the reference time, and the delay amount, by which the trigger signal outputted from the delay circuit 31 is delayed from the reference time. Only a low frequency component of the difference signal passes through the loop filter 73, and is inputted to the voltage control delay circuit 41. The delay circuit 41 feed-back controls the outputting timing of the reference signal so that the difference signal will be maintained at a predetermined fixed value.

When the sample 23 is irradiated with the pulse laser beam, the sample 23 emits fluorescent light. The fluorescent light travels through the optical system 24 and then falls incident on the photocathode 91. The incident timing, when the fluorescent light falls incident on the photocathode 91, is delayed, from the reference time when the trigger signal is generated from the optical trigger 22, by a delay amount of time td as shown in FIG. 4(*d*). The delay amount of time td is dependent on a difference between the optical path length between the half mirror 21 and the optical trigger 22 and the optical path length between the half mirror 21 and the: photocathode 91. When the fluorescent light thus falls incident on the photocathode 91, the photocathode 91 emits an electron beam, which is in turn deflected by the deflection electrodes 93 and 93', and streak swept along the phosphor screen 95, thereby forming a streak image.

The voltage control delay circuit 41 controls the delay amount of time Δt1, by which the reference signal is delayed from the reference time, so that the delay amount of time Δt of the deflection voltage signals will have a fixed amount of difference from the delay amount of time td, by which the fluorescent light is delayed in falling incident on the streak tube 90 from the reference time.

For example, in order to obtain a streak phosphor image immediately after the fluorescent intensity becomes maximum, the voltage control delay circuit 41 controls the delay amount of time Δt1 so that the delay amount of time Δ t of the deflection voltage signals will become equal to the delay amount of time td of the fluorescent light. That is, the voltage control delay circuit 41 may control the delay amount of time Δt1 so as to satisfy the following equation (2):

$$\Delta t=\Delta td \tag{2}$$

Alternatively, in order to obtain a streak phosphor image after a certain amount of time period td1 passes after the fluorescent intensity becomes maximum, the voltage control delay circuit 41 controls the delay amount of time Δt1 so that the delay amount of time Δt of the deflection voltage signals will become equal to a sum of the time td1 and the delay amount of time td of the fluorescent light. That is, the voltage control delay circuit 41 controls the delay amount of time Δt1 so as to satisfy the following equation (3):

$$\Delta t=td+td1 \tag{3}$$

In the case where the pulse laser beam is repeatedly emitted from the laser source 11 at a fixed time T, the above-described equations (2) and (3) are modified into the following equations (2a) and (3a):

$$\Delta t=td+nT \tag{2a}$$

$$\Delta t = td + td1 + nT \quad (3a)$$

where n is an integer.

That is, feedback control operation is performed to satisfy the equation (2a) or (3a).

It is noted that the delay circuit 61 is provided considering that the voltage control delay circuit 41 can provide only a small range of delay amount of time to the reference signal. It is assumed that the laser source 11 repeatedly emits light at the frequency of 100 MHz, that is, at the fixed time T of ten nanoseconds. In the case where the voltage control delay circuit 41 can provide a delay amount of one nanosecond at maximum, the delay circuit 61 is provided to compensate for the uncontrollable range of remaining nine nanoseconds. Accordingly, in the case where the voltage control delay circuit 41 can provide a sufficiently wide range of delay amount to the reference signal, the delay circuit 61 can be omitted.

Additionally, the voltage control delay circuit 41 can be operated to control the delay amount of time Δt1 to always satisfy the equation (2) or (2a). The delay circuit 61 may be designed to provide the delay time td1 of a desired fixed length.

The deflection voltage generator 50 generates heat when the generator 50 is driven to output the deflection voltages of several kilovolts. The delay amount of time Δt2 of the deflection voltage signals may possibly drift with regards to the reference signal inputted to the generator 50. Even when the delay amount of time Δt2 thus drifts, the delay amount of time Δt1 is feed-back controlled by the voltage control delay circuit 41 so that the total delay amount Δt of the deflection voltages will be maintained at a fixed value with regards to the trigger signal outputted from the trigger 22. Accordingly, the total delay amount Δt of the deflection voltages will be maintained unchanged with regards to the fluorescent light inputted to the streak tube 90.

Accordingly, even when a streak image is produced through streak sweeping a small intense fluorescent light a plurality of times to accumulate each streaked image into a resultant streak image, the resultant streak image will have a high signal-to-noise ratio and a high temporal resolution. Even when the sweeping range is switched, a stable streak image can be obtained immediately.

A second embodiment of the present invention will be described below with reference to FIG. 5.

Figure 5:
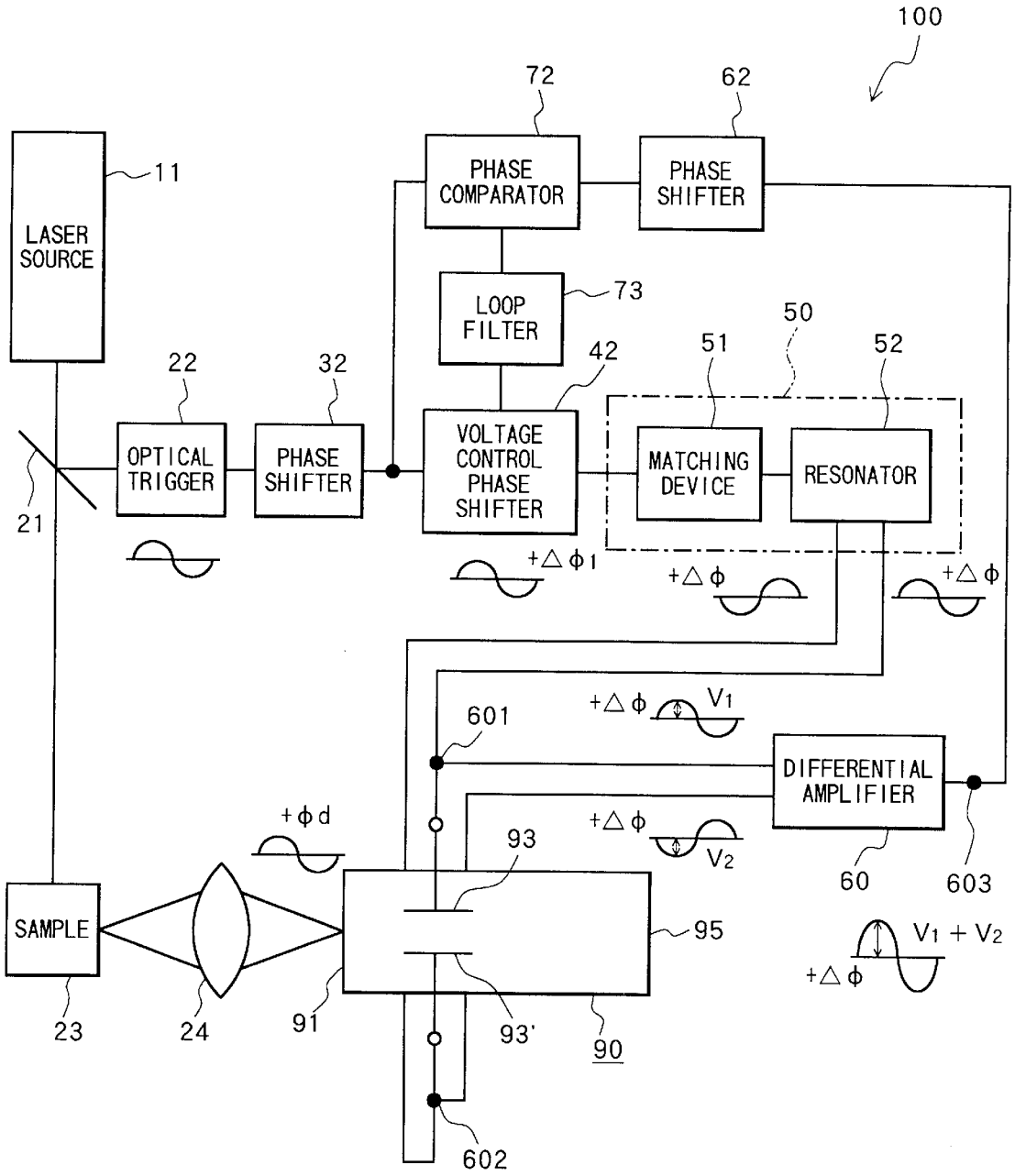
FIG. 5 shows a structure of an optical waveform detecting device of a second embodiment of the present invention.

FIG. 5 shows a structure of an optical waveform detecting device 100 of the present embodiment.

The optical waveform detecting device of the present embodiment is the same as that of the first embodiment except that a phase shifter 32 is provided in place of the delay circuit 31, that a voltage control phase shifter 42 is provided in place of the voltage control delay circuit 41, that another phase shifter 62 is provided in place of the delay circuit 61, that a phase comparator 72 is provided in place of the delay comparator 71, and that a combination of a matching device 51 and a resonator 52 is provided as the deflection voltage generator 50.

The optical waveform detecting device of the present embodiment is effective especially when the repetition frequency of the pulse laser beam emitted from the laser 11 is considerably high relative to the response of the optical trigger 22. In this case, the trigger signal outputted from the optical receiver 22 is not in a pulse shape, but is in a sine wave shape or a wave shape approximate to the sine wave. That is, the optical trigger 22 outputs an approximately sine wave-shaped trigger signal upon receiving an optical pulse train.

The optical waveform detecting device of the present embodiment is especially effective also when the streak tube 90 is desired to be driven in a synchroscanning sweeping mode. Also in this case, the deflection voltage signals, applied to the deflection electrodes 93 and 93', are in a sine waveform.

According to the present embodiment, upon receiving a part of the pulse laser beam repeatedly emitted from the laser 11, the optical trigger 22 outputs an approximately sine waveshaped trigger signal. The phase shifter 32 is provided for receiving the trigger signal, for shifting the phase of the received trigger signal by a predetermined shift amount, and then for outputting the phase-shifted trigger signal. The thus phase-shifted trigger signal is inputted to both the voltage control phase shifter 42 and the phase comparator 72. The voltage control phase shifter 42 is for receiving a difference signal outputted from the loop filter 73 and for shifting the phase of the trigger signal, supplied from the phase shifter 32, by a shift amount determined dependent on the difference signal. The phase shifter 42 then outputs the thus phase-shifted trigger signal as a reference signal.

The reference signal is inputted to the matching device 51 in the deflection voltage generator 50. The matching device 51 is for effectively transmitting the reference signal to the resonator 52 via an impedance matching method. The resonator 52 is for generating high voltage signals required to deflect the electron beam in the streak tube 90. In accordance with the reference signal of approximately the sine wave, the resonator 52 resonates with the deflection electrodes 93 and 93', thereby generating a pair of deflection voltage signals which are both of sine waveforms but which are in opposite polarities. The voltage generator 50 applies the pair of deflection voltage signals to the deflection electrodes 93 and 93', respectively. Difference between the deflection voltage signals, applied to the deflection electrodes 93 and 93', is detected by the differential amplifier 60. A signal of the measured deflection voltage difference is outputted from the differential amplifier 60 as a deflection voltage detection signal. The phase shifter 62 Is for receiving the deflection voltage detection signal and for shifting the phase of the deflection voltage detection signal by another predetermined shift amount. The phase-shifted deflection voltage detection signal is then supplied from the phase shifter 62 to the phase comparator 72.

The phase comparator 72 is for receiving the deflection voltage detection signal from the phase shifter 62 and for receiving the trigger signal from the phase shifter 32. The phase comparator 72 detects a difference between the phases of the deflection voltage detection signal and of the trigger signal. The phase comparator 72 then outputs a difference signal indicative of the phase difference. The difference signal is then supplied to the loop filter 73 where only a low frequency component of the difference signal is transmitted and then inputted to the voltage control phase shifter 42. The phase shifter 42 is constructed to shift the phase of a received trigger signal based on a voltage amount of the difference signal supplied from the loop filter 73. The phase shifter 42 therefore shifts the phase of the trigger signal, supplied from the phase shifter 32, based on the difference signal outputted from the loop filter 73. The phase shifter 42 thus outputs the phase-shifted trigger signal as a reference signal. More specifically, the phase shifter 42 decreases the shift amount of the reference signal when the difference signal is equal to or higher than the predetermined value, and increases the shift amount of the reference signal when the difference signal is lower than the predetermined value. Thus, the phase shifter 42 maintains the phase of the difference signal to a predetermined fixed value. Normally, the phase shifter 42 serves to perform this feedback control operation to maintain the phase of the difference signal at the value of zero or 90 degrees ($\pi/2$).

With the above-described structure, the optical waveform detecting device 100 of the present embodiment operates as described below.

The pulse laser beam repeatedly outputted from the laser source 11 is splitted by the half mirror 21 into two laser beams. One laser beam is inputted into the optical trigger 22, which in turn emits an approximately sinewave-shaped trigger signal. The phase of the trigger signal will be referred to as a reference phase hereinafter. The phase of the trigger signal is shifted by the phase shifter 32 by the predetermined shift amount. The phase of the thus phase-shifted trigger signal is further shifted by the voltage control phase shifter 42 in accordance with the difference signal supplied from the loop filter 73. The thus further phase-shifted trigger signal is outputted from the phase shifter 42 as a reference signal. The phase of the reference signal is therefore shifted by the phase shifters 32 and 42 by a shift amount a $\Delta\phi 1$ in total from the original phase of the trigger signal as outputted from the optical trigger 22.

The reference signal is then supplied from the voltage control phase shifter 42 to the deflection voltage generator 50. The deflection voltage generator 50 resonates in accordance with the reference signal, and simultaneously generates a pair of sinewave deflection voltage signals. The pair of deflection voltage signals have opposite polarities to each other. The deflection voltage signals are applied to the deflection electrodes 93 and 93', respectively. The phase of the deflection voltage signals are shifted also in the deflection voltage generator 50. That is, when outputted from the voltage generator 50, the phase of the deflection voltage signals are further shifted by an additional shift amount $\Delta\phi 2$ from the reference signal as inputted to the voltage generator 50. Accordingly, the phase of the deflection voltage signals, applied to the deflection electrodes 93 and 93', is shifted by a total shift amount $\Delta\phi$ which satisfies the following equation (4):

$$\Delta\phi=\Delta\phi 2 \tag{4}$$

where $\Delta\phi 2$ is not fixed, but drifts due to changes in the temperature of the deflection voltage generator 50.

Difference between the deflection voltage signals, applied to the deflection electrodes 93 and 93', is detected by the differential amplifier 60, Which in turn outputs a deflection voltage detection signal indicative of the detected difference. Because the differential amplifier 60 has the same structure as shown in FIG. 3(*b*), the deflection voltage detection signal outputted from the amplifier 60 is approximately of the sine wave having the same phase timing as the inputted deflection voltage signals. The phase of the deflection voltage detection signal is then shifted by the other predetermined amount by the phase shifter 62, and then inputted to the phase comparator 72. The phase comparator 72 compares the phase of the deflection voltage detection signal with the phase of the trigger signal inputted from the phase shifter 32. The phase comparator 72 outputs a difference signal indicative of the difference between the phase amounts of the deflection voltage detection signal and of the trigger signal. Only a low frequency component of the difference signal passes through the loop filter 73, and is inputted to the voltage control phase shifter 42. The phase of the reference signal inputted to the voltage control phase shifter 42 is shifted by the voltage control phase shifter 42 so that the difference signal will be maintained to the predetermined fixed value.

When the sample 23 is irradiated with the pulse laser beam, the sample emits fluorescent light. The fluorescent light travels through the optical system 24 and then falls incident on the photocathode 91. The incident timing, when the fluorescent light falls incident on the photocathode 91, is delayed from the generating timing of the trigger signal, originally issued at the trigger 22, by a phase shift amount of $\phi d$. The phase shift amount $\phi d$ is dependent on a difference between the optical path length between the half mirror 21 and the trigger 22 and the optical path length between the half mirror 22 and the photocathode 91. When the fluorescent light thus falls incident on the photocathode 91, the photocathode 91 emits an electron beam, which is in turn deflected by the deflection electrodes 93 and 93', and streak swept on the phosphor screen 95, thereby forming a streaked image.

The voltage control phase shifter 42 controls the phase shift amount $\Delta\phi 1$, by which the phase of the reference signal is shifted, so that the phase shift amount $\Delta\phi$ of the deflection voltage signals, applied to the deflection electrodes 93 and 93', will have a fixed amount of difference from the phase shift amount $\phi d$, by which the phase of the fluorescent light is shifted from the reference phase when falling incident on the streak tube 90.

For example, in order to obtain a streaked phosphor image immediately after the fluorescent intensity becomes maximum, the voltage control phase shifter 42 controls the shift amount $\Delta\phi 1$ so that the shift amount $\Delta\phi$ of the deflection voltage signals will become equal to the shift amount $\phi d$ of the fluorescent light. That is, the voltage control phase shifter 42 controls the shift amount $\Delta\phi 1$ so as to satisfy the following equation (5):

$$\Delta\phi=\phi d \tag{5}$$

Alternatively, in order to obtain a streaked phosphor image after a phase amount $\phi d1$ shifts after the fluorescent intensity becomes maximum, the voltage control phase shifter 42 controls the shift amount $\Delta\phi 1$ so that the phase shift amount $\Delta\phi$ of the deflection voltage signals will become equal to a sum of the phase shift amount $\Delta\phi d1$ and the phase shift amount $\phi d$ of the fluorescent light. That is, the voltage control phase shifter 42 controls the shift amount $\Delta\phi 1$ so as to satisfy the following equation (6):

$$\Delta\phi=\Delta d+1 \tag{6}$$

In the case where the pulse laser beam is repeatedly emitted from the laser source 11 at a fixed time T, the above-described equations (5) and (6) are modified into the following equations (5a) and (6a):

$$\Delta\phi=\phi d+2n\pi \tag{5a}$$

$$\Delta\phi=\phi d+\phi d1+2\pi \tag{6a}$$

where n is an integer, and $\pi$ is the ratio of the circumference of a circle to its diameter.

That is, the phase shifter 42 performs the feedback control operation to satisfy the equation (5a) or (6a).

It is noted that the phase shifter 62 is provided because the phase shifter 42 can provide phase shift of only a small range of amount to the reference signal. It is assumed that the laser source 11 repeatedly emits light at the frequency of 100 MHz, that is, at the fixed time T of ten nanoseconds. In the case where the phase shifter 42 can provide a one nanosecond's worth of phase shift at maximum, the phase shifter 62 is provided to compensate for the uncontrollable range of remaining nine nanoseconds' worth of phase. Accordingly, in the case where the phase shifter 42 can provide a sufficiently wide range of phase shift amount to the reference signal, the phase shifter 62 can be omitted.

Additionally, the phase shifter 42 can be operated to control the shift amount of phase $\Delta\phi 1$ so as to always satisfy the equation (5) or (5a). The phase shifter 62 may be designed to provide the phase difference $\phi d1$ of a desired fixed amount.

The deflection voltage generator 50 generates heat when outputting the deflection voltage signals of several kilovolts. Accordingly, the shift amount of phase $\Delta\phi 2$ of the deflection voltage signals, outputted from the generator 50, may possibly drift with regards to the reference signal inputted to the generator 50. Even when the shift amount of phase $\Delta\phi 2$ thus drifts, however, the shift amount of phase $\Delta\phi 1$ is feedback controlled by the phase shifter 42 so that the total shift amount $\Delta\phi$ of the deflection voltage signals will be maintained at a fixed value with regards to the trigger signal outputted from the trigger 22. Accordingly, even when a streaked image is produced through streak sweeping a small intense fluorescent light a plurality of times to accumulate the obtained plural streaked images, a resultant streaked image will have a high signal-to-noise ratio and a high temporal resolution. Even when the sweeping range is changed, a stable streaked image can be obtained immediately.

A third embodiment of the present invention will be described below with reference to FIG. 6.

Figure 6:
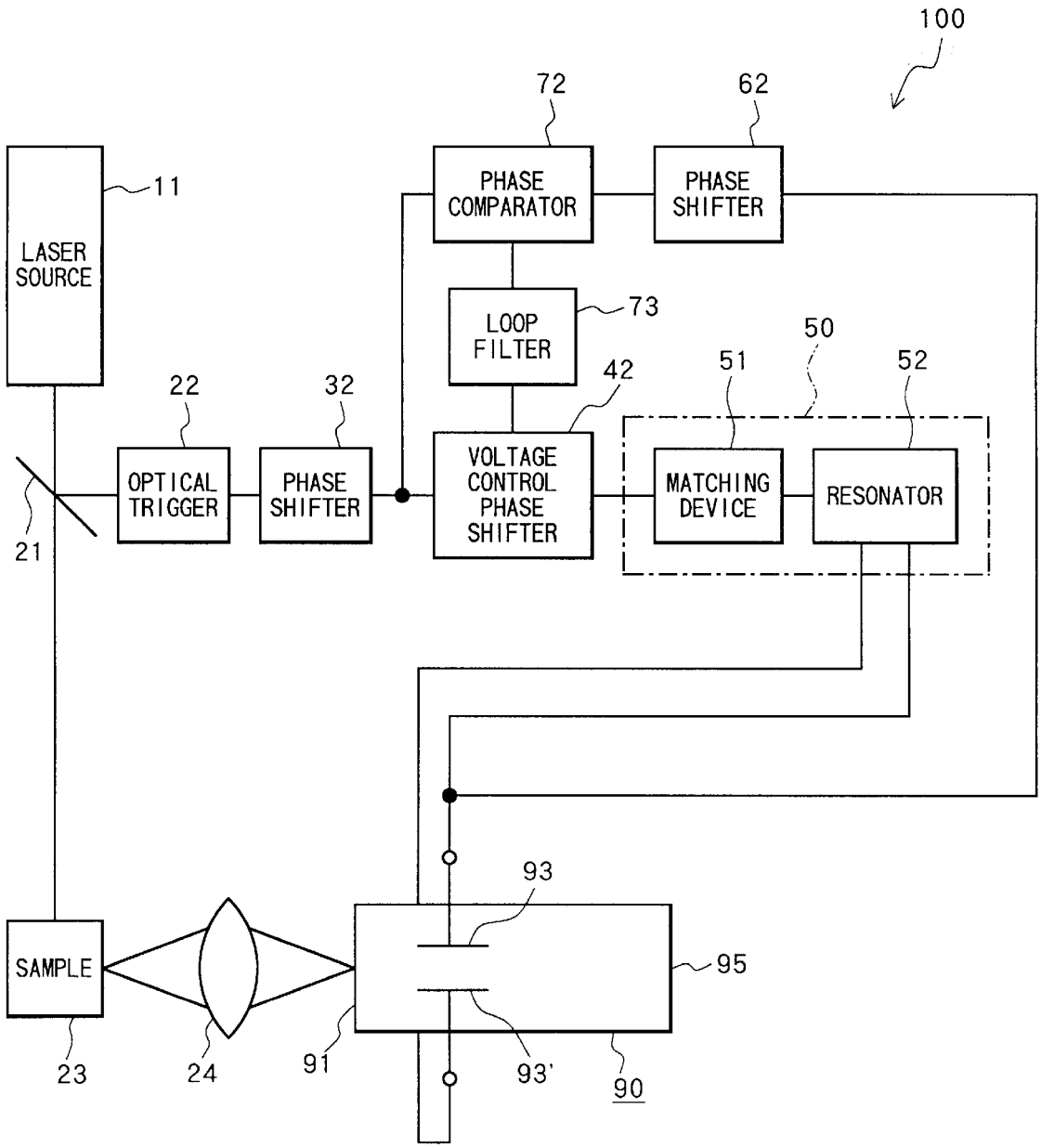
FIG. 6 shows a structure of an optical waveform detecting device of a third embodiment of the present invention.

FIG. 6 shows a structure of an optical waveform detecting device of the third embodiment.

The optical waveform detecting device of the present embodiment is the same as that of the second embodiment except that the differential amplifier 60 is omitted and that the electric potential of only one of the pair of electrodes 93 and 93' is directly inputted to the phase shifter 62.

It is noted that in both of the above-described first and second embodiments, the differential amplifier 60 is constructed from the balanced-to-unbalanced transformer shown in FIG. 3(*b*) for measuring the electric potentials of both of the pair of plate electrodes 93 and 93' and for detecting the difference between the measured potential levels. That is, the pair of plate electrodes 93 and 93' are detected in a balanced condition. Accordingly, even when the pair of deflection voltage signals, applied to the electrodes 93 and 93', are generated to have different waveforms or are generated at different timings due to noises generated in the voltage generator 50, the electric potential difference actually established between the electrodes 93 and 93' can be properly detected at the differential amplifier 60.

When the pair of deflection voltage signals applied to the electrodes 93 and 93' are completely in synchronization with each other, and are therefore in synchronization with the electric potential difference between the electrodes 93 and 93', the electric potential of each electrode can properly indicate the potential difference between the electrodes 93 and 93'. In this case, therefore, as shown in FIG. 6, the differential amplifier 60 is not needed. The potential of one of the electrodes 93 and 93' is directly inputted to the phase shifter 62. In other words, the pair of plate electrodes 93 and 93' are detected in an unbalanced condition. Electric potential of only one of the electrodes is measured, and is used as the deflection voltage detection signal.

The operation and effects of the optical waveform detecting device of the present embodiment are the same as those of the second embodiment except that data of the deflection voltage is directly inputted to the phase shifter 62, but not via the differential amplifier 60.

A fourth embodiment of the present invention will be described below with reference to FIG. 7.

Figure 7:
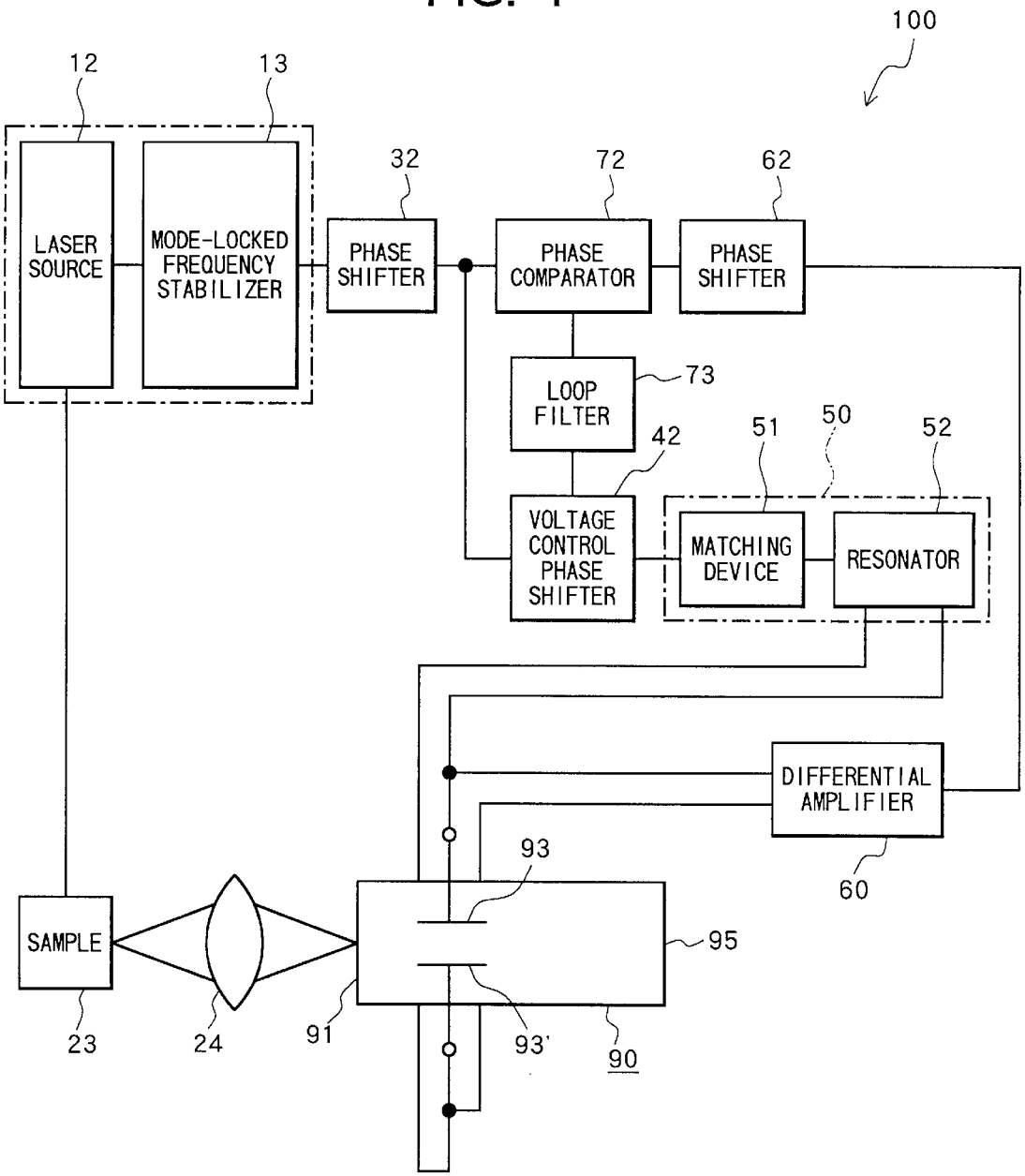
FIG. 7 shows a structure of an optical waveform detecting device of a fourth embodiment of the present invention.

FIG. 7 shows a structure of an optical waveform detecting device 100 of the present embodiment.

The optical waveform detecting device 100 of the present embodiment is the same as that of the second embodiment except that a laser source 12 is provided with a mode-locked frequency stabilizer 13, that the half mirror 21 and the optical trigger 22 are omitted, and that a trigger signal, outputted from the mode-locked frequency stabilizer 13, is directly inputted to the phase shifter 32.

The mode-locked frequency stabilizer 13 is for oscillating, at a fixed frequency, a trigger signal for driving the laser source 12. The laser source 12 repeatedly emits a pulse laser in synchronization with the trigger signal outputted from the mode-locked frequency stabilizer 13. Accordingly, the trigger signal, outputted from the mode-locked frequency stabilizer 13, is equivalent to the trigger signal outputted from the optical trigger 22 in the second embodiment.

According to the present embodiment, therefore, the phase shifter 32 is designed for receiving the trigger signal outputted from the mode-locked frequency stabilizer 13, and for shifting the phase of the received trigger signal. The operation and effects of the device of the present embodiment are the same as that of the second embodiment. Because the device of the present embodiment does not use the optical trigger 22, the device will not suffer from external noises.

A fifth embodiment of the present invention will be described below with reference to FIG. 8.

Figure 8:
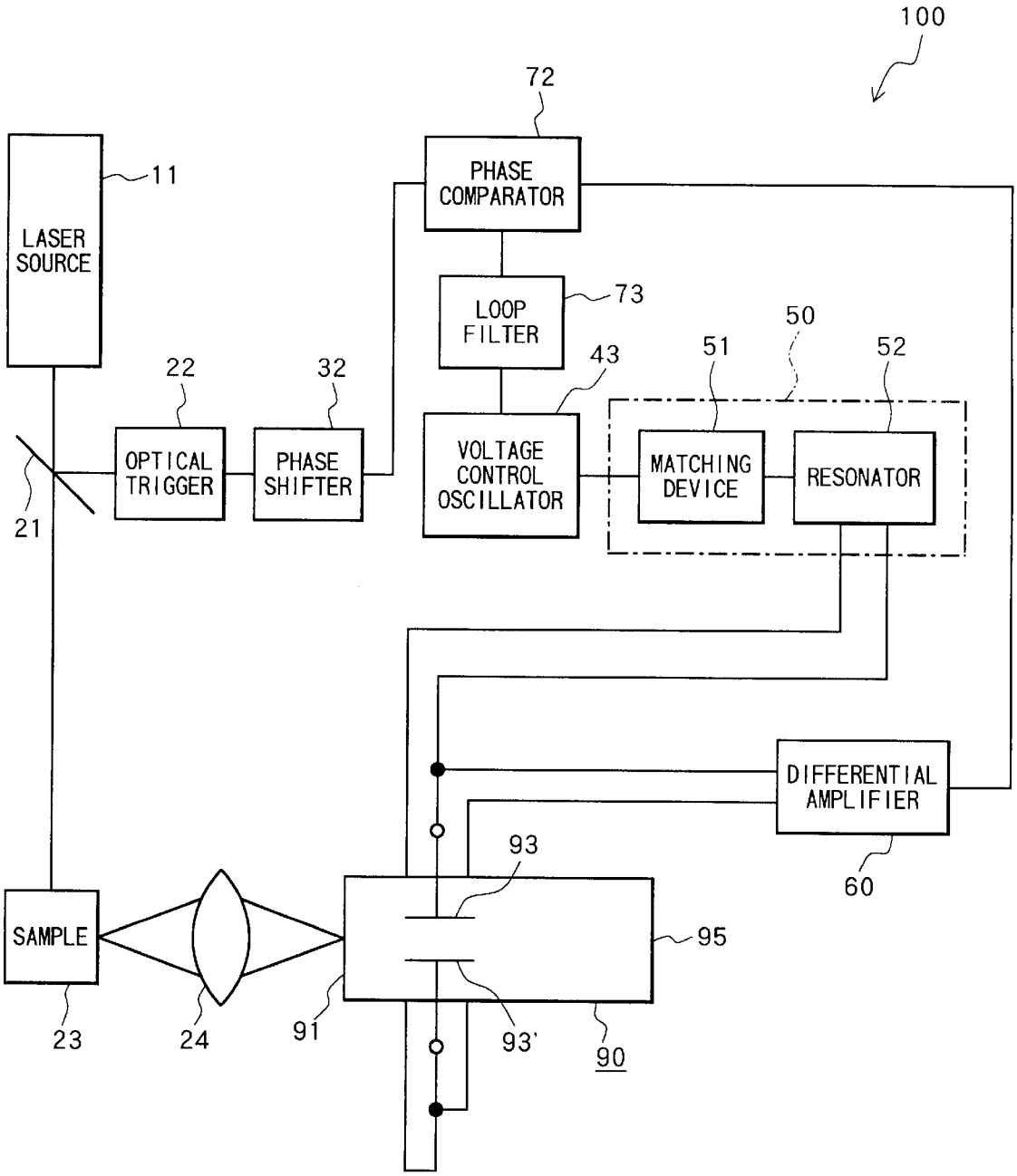
FIG. 8 shows a structure of an optical waveform detecting device of a fifth embodiment of the present invention.

FIG. 8 shows the structure of an optical waveform detecting device 100 of the fifth embodiment.

The optical waveform detecting device 100 of the fifth embodiment is the same as that of the second embodiment except that a voltage control oscillator 43 is provided in place of the voltage control phase shifter 42, that the trigger signal outputted from the phase shifter 32 is inputted only to the phase comparator 72, and that the phase shifter 62 is omitted.

The voltage control oscillator 43 is for oscillating a reference signal, whose frequency and phase is adjusted based on the difference signal supplied from the loop filter 73. That is, the voltage control oscillator 43 generates the reference signal while feedback controlling its frequency and phase so that the difference signal, outputted from the loop filter 73, will have a predetermined frequency and a predetermined phase difference with regards to the trigger signal as outputted from the optical trigger 22.

The voltage control oscillator 43 is constructed from, for example, a quartz oscillator. The quartz oscillator is especially preferable when the repetition frequency of the laser source 11 is relatively stable. A reference signal outputted from the oscillator 43 is inputted to the deflection voltage generator 50, which in turn generates a pair of deflection voltage signals based on the reference signal. Thus, it is unnecessary to supply the oscillator 43 with the trigger signal outputted from the phase shifter 32. The phase shifter 62 can be omitted because the oscillator 43 can control the phase of the reference signal in a sufficiently wide range.

The operation of the device of the present embodiment is the same as that of the second embodiment except that the frequency and phase of the reference signal, oscillated by the oscillator 43, is feedback controlled to maintain, to a desired fixed value, the phase of the deflection voltage signals applied to the electrodes 93 and 93'. The device of the present embodiment attains the same effects as those attained by that of the second embodiment.

While the invention has been described in detail with reference to the specific embodiments thereof, it would be apparent to those skilled in the art that various changes and modifications may be made therein without departing from the spirit of the invention.

For example, various types of deflection electrodes other than the pair of parallel plate electrodes 93 and 93' may be employed for deflecting the electron beam.

Figure 9:
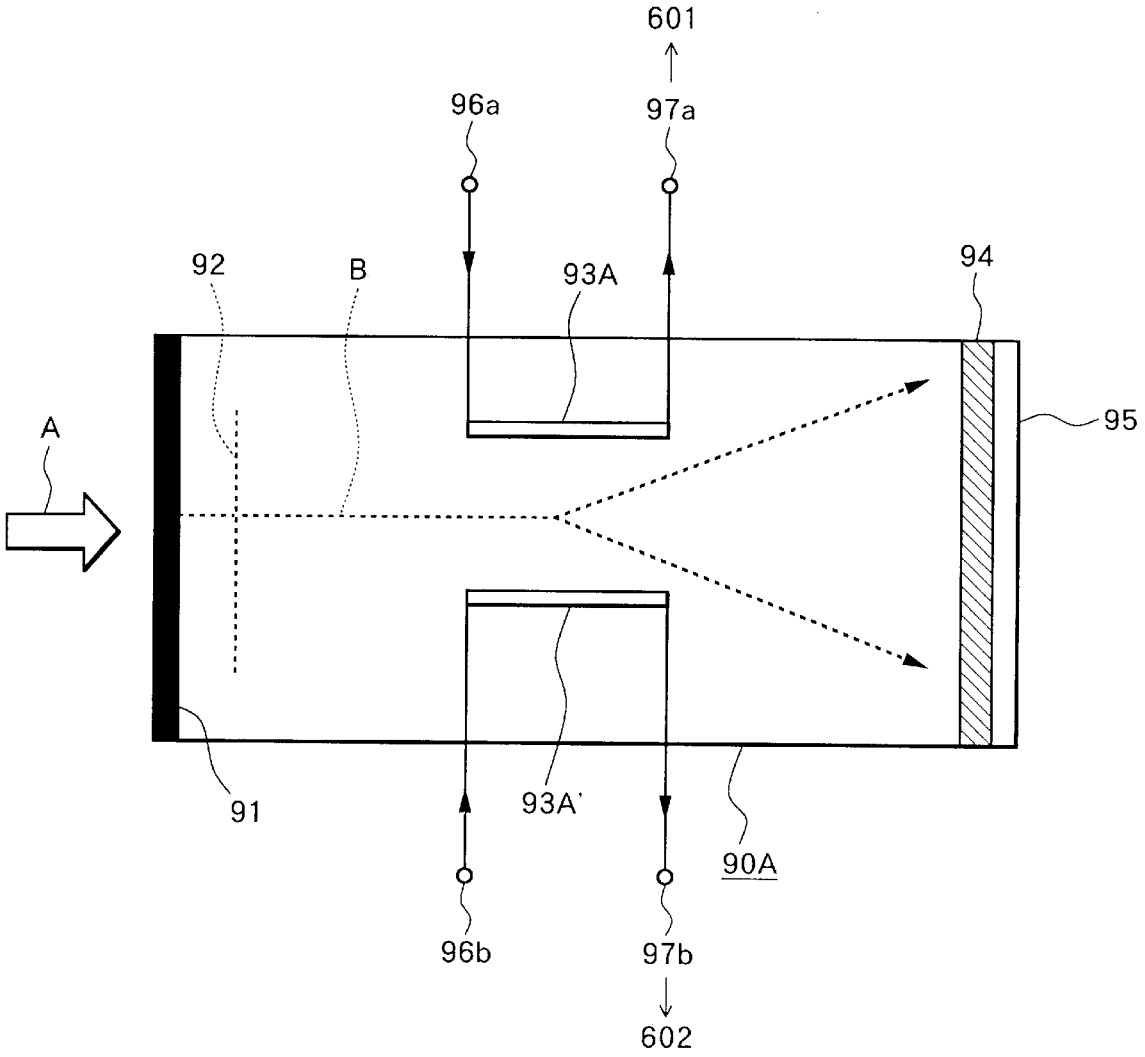
FIG. 9 shows a structure of a traveling-wave type streak tube.

The streak tube may be provided with a pair of traveling wave deflection plate electrodes 93A and 93A' as shown in FIG. 9. In the streak tube 90A of FIG. 9, when a pair of deflection voltages are applied to the traveling wave deflection plates 93A and 93A', an electric potential travels on each deflection plate at approximately the same speed in the same direction with the electron beam B. The traveling wave deflection plates 93A and 93A' can therefore highly efficiently deflect the electron beam B. In more concrete terms, the deflection voltage signals are initially applied to both and terminals 96*a* and 96*b*, of the electrodes 93A and 93A', which are located closest to the photocathode 91. Then, an electric potential generated on each electrode 93A (93A') travels in a direction toward the phosphor screen 95 at a speed approximately the same as the speed, at which the electron beam B travels. In this case, the differential amplifier 60 is inputted with the electric potentials at opposite end terminals 97*a* and 97*b* which are located closest to the phosphor screen 95. That is, the input terminals 601 and 602 of the differential amplifier 60 are connected to the end terminals 97*a* and 97*b*, respectively. When the input timing or the phase of the deflection voltages, applied to the electrodes 93A and 93A', drifts with regards to the traveling timing or the phase of the electron beam, the signal-to-noise ratio and the temporal resolution of a streaked image may possibly be deteriorated. However, when the present invention is applied to this type of streak tube, a streaked image of a high signal-to-noise ratio and of high time resolution can be obtained.

Additionally, temperature control may be performed to maintain, to be fixed, the temperature of the respective elements in the optical waveform detecting device 100. For example, in the device of the second embodiment shown in FIG. 5, the temperature of the phase shifter 32, the voltage control phase shifter 42, the differential amplifier 60, the phase shifter 62, the phase comparator 72, and the loop filter 73 may be controlled to be fixed. The temperature control may be performed with air, a Peltier element, or the like. It is noted that the temperature of all these elements may not be controlled. The temperature of only a part of these elements may be controlled. Because the phase comparator 72 is required to have high stability, the temperature of the phase comparator 72 is preferably controlled. Noise control is also preferably attained onto the phase comparator 72. In this case, drifts of the deflection voltage will be further reduced.

The above-described modifications can be applied to other embodiments.

Similarly, the structures shown in the third through fifth embodiments and the structure of the above-described modification can be applied to the device of the first embodiment.

As described above, according to the optical waveform detecting device of the present invention, the streak tube has a photoelectric conversion surface (photocathode) for receiving a pulse-shaped optical beam and for emitting an electron beam according to an intensity of the received optical beam; The deflection electrode forms an electric field in a direction orthogonal to a direction in which the electron beam travels, thereby deflecting the electron beam. The output surface of the streak tube receives the electron beam and accordingly forms a streaked image in accordance with the intensity of the electron beam.

According to the optical waveform detecting device of the present invention, a trigger signal is generated in synchronization with the pulse optical beam which falls incident on the photoelectric conversion surface of the streak tube. A deflection voltage is generated in accordance with the trigger signal, and is applied to the deflection electrode. The deflection voltage applied onto the deflection electrode is detected, and a deflection voltage detection signal is generated. Difference between the timing of the deflection voltage detection signal and the timing of the trigger signal is detected, and a difference signal is generated. Based on the difference signal, a reference signal is generated for controlling the timing of the deflection voltage to be applied to the deflection electrode.

When a pulse-shaped trigger signal is generated as described in the first embodiment, difference between the generation time of the deflection voltage detection signal and the generation time of the trigger signal is detected. Based on the difference signal indicative of the detected difference, the generating timing of the reference signal is controlled, thereby controlling the generation timing of the deflection voltage. When a sine wave-shaped trigger signal is generated as described in the second embodiment, difference between the phase of the deflection voltage detection signal and the phase of the trigger signal is detected. Based on the difference signal indicative of the detected difference, the phase of the reference signal is controlled, thereby controlling the timing of the deflection voltage.

Heat is generated while the deflection voltage is generated. As a result, the deflection voltage may possibly drift. When the deflection voltage thus drifts, however, the timing of the deflection voltage is feedback controlled to be fixed with regards to the timing of the optical beam to be detected. Accordingly, even when a streaked image is desired to be produced through streak sweeping a small intense fluorescent light a plurality of times to accumulate a plurality of streaked images, a resultant streaked image will have a high signal-to-noise ratio and a high temporal resolution. Even when the sweeping range is changed, a stable streaked image can be obtained immediately.

According to the embodiments, the deflection electrode is constructed from the pair of plate electrodes. In this case, the balanced-to-unbalanced transformer is preferably used for detecting a difference between electric potentials of the pair of plate electrodes. When detecting a difference between the electric potentials of the pair of plate electrodes, noises applied to both of the plate electrodes can be removed. Accordingly, the deflection voltage becomes stable. It is possible to obtain a streaked image of a high signal-to-noise ratio and of a high temporal resolution.

According to the embodiments, the loop filter is provided for transmitting therethrough a low frequency component of the difference signal. The reference signal is generated based on the low frequency component of the difference signal. Because the loop filter can remove noise components from the difference signal, it is possible to control the timing of the deflection voltage with regards to the optical beam at a desired response.

According to the first embodiment, the voltage control delay circuit is provided for receiving both the trigger signal and the difference signal, adjusts the delay time of the trigger signal based on the difference signal, and outputs the adjusted trigger signal as the reference signal. In this case, the trigger signal is adjusted in its delay amount, and the thus adjusted trigger signal is outputted as the reference signal. In the second through fourth embodiments, the voltage control phase shifter is provided for receiving both the trigger signal and the difference signal, adjusts the phase of the trigger signal based on the difference signal, and outputs the adjusted trigger signal as the reference signal. In this case, the trigger signal is adjusted in its phase, and the thus adjusted trigger signal is outputted as the reference signal.

According to the fifth embodiment, the voltage control oscillator is provided for oscillating according to the difference signal and outputs the reference signal. Without receiving the trigger signal, the voltage control oscillator can oscillate and output the reference signal.

In the second through fifth embodiments, in order to generate the deflection voltage, the combination of the resonator and the matching device is employed. The matching device provides an impedance matching between the voltage control phase shifter and the resonator, thereby highly efficiently transmitting the power of the reference signal to the resonator. In accordance with the reference signal, the resonator resonates together with the deflection electrodes, thereby generating the deflection voltage. In this case, the power of the reference signal is highly efficiently transmitted to the resonator, which in turn resonates to generate the deflection voltage. According to this structure, it is possible to measure high speed optical phenomenon through a synchroscanning method. When the phase of the deflection voltage drifts, the drifts will be affected onto the signal-to-noise ratio and the temporal resolution of the resultant streaked image. However, the present invention can provide a streaked image of a high signa1-to-noise ratio and a high temporal resolution.

What is claimed is:

1. An optical waveform detecting device for detecting a waveform of a pulse-shaped optical beam, the device comprising:

a streak tube having a photoelectric conversion surface for receiving a pulse-shaped optical beam and for emitting an electron beam according to an intensity of the optical beam, a deflection electrode for forming an electric field in a direction orthogonal to a direction in which the electron beam travels, thereby deflecting the electron beam, and an output surface for receiving the electron beam and for outputting a streaked image in accordance with an intensity of the received electron beam;

trigger signal generating means for generating a trigger signal in synchronization with the optical beam;

deflection voltage generating means for generating a deflection voltage based on the trigger signal, and for applying the deflection voltage onto the deflection electrode;

deflection voltage detection means for detecting the deflection voltage applied to the deflection electrode, and for outputting a deflection voltage detection signal indicative of the detected deflection voltage;

comparing means for detecting difference between a timing of the deflection voltage detection signal and a timing of the trigger signal and for outputting a difference signal indicative of the detected timing difference; and deflection voltage control means for outputting a reference signal, based on the difference signal, for controlling a timing of the deflection voltage to be outputted from the deflection voltage generating means to the deflection electrode.

2. An optical waveform detecting device of claim 1, wherein the deflection voltage control means includes a loop filter for transmitting a low frequency component of the difference signal and for generating the reference signal based on the low frequency component of the difference signal.

3. An optical waveform detecting device of claim 1, wherein the deflection voltage control means receives both the trigger signal and the difference signal, adjusts timing of the trigger signal based on the difference signal, and outputs the adjusted trigger signal as the reference signal.

4. An optical waveform detecting device of claim 1, wherein the deflection electrode is constructed from a pair of electrode plates, and wherein the deflection voltage control means includes a balanced-to-unbalanced transformer for detecting difference between electric potentials of the pair of electrode plates.

5. An optical waveform detecting device of claim 1, further comprising temperature control means for controlling temperature of at least one of the deflection voltage detecting means, the comparing means, and the deflection voltage control means.

6. An optical waveform detecting device of claim 1, wherein the trigger signal generating means generates a pulse-shaped trigger signal upon receiving a pulse-shaped optical beam, the deflection voltage generating means generating a deflection voltage of a predetermined waveform based on the trigger signal and applying the deflection voltage onto the deflection electrode, the deflection voltage detection means detecting the deflection voltage and outputting a deflection voltage detection signal, wherein the comparing means receives both the deflection voltage detection signal and the trigger signal, and detects time difference between a reception time of the deflection voltage detection signal and a reception time of the trigger signal, the comparing means outputting a difference signal indicative of the detected time difference, and wherein the deflection voltage control means outputs the reference signal, based on the difference signal, for controlling a generating timing of the deflection voltage to be applied to the deflection electrode.

7. An optical waveform detecting device of claim 6, wherein the deflection voltage control means includes a delay circuit for receiving the trigger signal from the trigger signal generating means and for outputting the reference signal to the deflection voltage generating means after a delay time of an amount which is determined dependent on the time difference indicated by the difference signal.

8. An optical waveform detecting device of claim 7, further comprising:

a first additional delay circuit for receiving the trigger signal from the trigger signal generating means and for outputting the trigger signal to the delay circuit after a first predetermined amount of delay time; and a second additional delay circuit for receiving the deflection voltage detection signal from the deflection voltage detection means and for outputting the deflection voltage detection signal to the comparing means after a second predetermined amount of delay time.

9. An optical waveform detecting device of claim 1, wherein the trigger signal generating means generates an approximately sine wave-shaped trigger signal upon receiving the optical beam, the deflection voltage generating means generating an approximately sine wave-shaped deflection voltage based on the trigger signal and applying the sine wave-shaped deflection voltage onto the deflection electrode, the deflection voltage detection means detecting the approximately sine wave-shaped deflection voltage and outputting an approximately sine wave-shaped deflection voltage detection signal, wherein the comparing means receives both the deflection voltage detection signal and the trigger signal, and detects phase difference between a phase of the deflection voltage detection signal and a phase of the trigger signal, the comparing means outputting a difference signal indicative of the detected phase difference, and wherein the deflection voltage control means outputs the reference signal, based on the difference signal, for controlling a phase of the deflection voltage to be outputted to the deflection electrode.

10. An optical waveform detecting device of claim 9, wherein the deflection voltage control means includes a phase shifter for receiving the trigger signal from the trigger signal generating means, for shifting a phase of the trigger signal with a shift amount determined dependent on the phase difference indicated by the difference signal, and for outputting the phase-shifted trigger signal as the reference signal to the deflection voltage generating means.

11. An optical waveform detecting device of claim 10, further comprising:

a first additional phase shifter for receiving the trigger signal from the trigger signal generating means, for shifting the phase of the trigger signal with a first predetermined shift amount, and for outputting the phase-shifted trigger signal to the phase shifter; and a second additional phase shifter for receiving the deflection voltage detection signal from the deflection voltage detection means, for shifting the phase of the deflection voltage detection signal with a second predetermined shift amount, and for outputting the phase-shifted deflection voltage detection signal to the comparing means.

12. An optical waveform detecting device of claim 9, wherein the deflection voltage control means includes an oscillator for oscillating according to the difference signal, thereby outputting the reference signal.

13. An optical waveform detecting device of claim 9, wherein the deflection voltage generating means includes:

a resonator for resonating together with the deflection electrode in accordance with the reference signal, thereby generating the deflection voltage; and a matching device for providing an impedance matching between the deflection voltage control means and the resonator, thereby transmitting the power of the reference signal to the resonator.

14. An optical waveform detecting device of claim 1, further comprising a laser source for emitting a pulse laser beam onto a sample, the sample emitting a pulse-shaped optical beam toward the photoelectric conversion surface.

15. An optical waveform detecting device of claim 1, wherein the trigger signal generating means includes a mode-locked frequency stabilizer for outputting a trigger signal for driving the laser source.

16. An optical waveform detecting device for detecting a waveform of a pulse-shaped optical beam, comprising:

a streak tube having a photoelectric conversion surface for receiving a pulse-shaped optical beam and for emitting an electron beam according to an intensity of the optical beam, a deflection electrode for forming an electric field in a direction orthogonal to a direction in which the electron beam travels, thereby deflecting the electron beam, and an output surface for receiving the electron beam and for outputting a streaked image in accordance with an intensity of the received electron beam;

a trigger signal generator for generating a trigger signal in synchronization with the optical beam;

a reference signal generator for generating a reference signal;

a deflection voltage generator for receiving the reference signal, for generating a deflection voltage based on the reference signal, and for applying the deflection voltage onto the deflection electrode;

a deflection voltage detector for detecting the deflection voltage applied to the deflection electrode, and for outputting a deflection voltage detection signal indicative of the detected deflection voltage; and a feedback controller for receiving both the deflection voltage detection signal and the trigger signal, for detecting time difference between a reception time of the deflection voltage detection signal and a reception time of the trigger signal, and for outputting, to the reference signal generator, a difference signal indicative of the detected timing difference, the difference signal feedback controlling the time when the reference signal generator generates the reference signal.

17. An optical waveform detecting device of claim 16, wherein the reference signal generator includes a delay circuit for receiving the trigger signal from the trigger signal generator and for outputting the reference signal to the deflection voltage generator, the delay circuit being feedback controlled by the feedback controller to output the reference signal after a delay time of an amount, which is determined dependent on the time difference indicated by the difference signal, passes after the delay circuit receives the trigger signal.

18. An optical waveform detecting device for detecting a waveform of a pulse-shaped optical beam, comprising:

a streak tube having a photoelectric conversion surface for receiving a pulse-shaped optical beam and for emitting an electron beam according to an intensity of the optical beam, a deflection electrode for forming an electric field in a direction orthogonal to a direction in which the electron beam travels, thereby deflecting the electron beam, and an output surface for receiving the electron beam and for outputting a streaked image in accordance with an intensity of the received electron beam;

a trigger signal generator for generating a trigger signal in synchronization with the optical beam;

a reference signal generator for generating a reference signal;

a deflection voltage generator for receiving the reference signal, for generating a deflection voltage based on the reference signal, and for applying the deflection voltage onto the deflection electrode;

a deflection voltage detector for detecting the deflection voltage applied to the deflection electrode, and for outputting a deflection voltage detection signal indicative of the detected deflection voltage; and a feedback controller for receiving both the deflection voltage detection signal and the trigger signal, for detecting phase difference between a phase of the deflection voltage detection signal and a phase of the trigger signal, and for outputting, to the reference signal generator, a difference signal indicative of the detected phase difference, the difference signal feedback controlling the phase of the reference signal to be outputted-from the reference signal generator.

19. An optical waveform detecting device of claim 18, wherein the reference signal generator includes a phase shifter for receiving the trigger signal from the trigger signal generator and for outputting the reference signal to the deflection voltage generator, the phase shifter being feedback controlled by the feedback controller to shift the phase of the trigger signal with a shift amount, which is determined dependent on the phase difference indicated by the difference signal, and to output the phase-shifted trigger signal as the reference signal.

* * * * *